US005949200A

United States Patent [19]

Ference et al.

[11] Patent Number: 5,949,200

[45] Date of Patent: Sep. 7, 1999

[54] WALL MOUNTABLE CONTROL SYSTEM WITH VIRTUALLY UNLIMITED ZONE CAPACITY

[75] Inventors: Jonathan H. Ference, Riegelsville; Frederick J. Lind, III, Emmaus; Robert Paul Stocker, Bethlehem, all of Pa.

[73] Assignee: Lutron Electronics Co., Inc., Coopersburg, Pa.

[21] Appl. No.: 08/688,500

[22] Filed: Jul. 30, 1996

[51] Int. Cl.[6] ..... H05B 37/00; H05B 37/02

[52] U.S. Cl. ..... 315/318; 315/312; 315/DIG. 4; 315/316; 315/295; 307/126

[58] Field of Search ..... 340/825.03, 825.06; 307/126, 34, 38, 40, 42, 157; 315/DIG. 4, 317, 318, 319, 312, 316, 295

[56] References Cited

U.S. PATENT DOCUMENTS

| | | | |
|---|---|---|---|
| D. 325,728 | 4/1992 | Mayo et al. | D14/100 |
| D. 344,264 | 2/1994 | D'Aleo et al. | D13/164 |
| 4,924,151 | 5/1990 | D'Aleo et al. | 315/295 |
| 5,059,871 | 10/1991 | Pearlman et al. | 315/316 |
| 5,187,655 | 2/1993 | Post et al. | 315/295 X |
| 5,191,265 | 3/1993 | D'Aleo et al. | 315/295 |
| 5,430,356 | 7/1995 | Ference et al. | 315/291 |
| 5,530,322 | 6/1996 | Ference et al. | 315/295 |

OTHER PUBLICATIONS

Pre–Pack™ Architectural Lighting Control Systems Part I: Design Guide, 2nd Edition,Lutron Electronics Co., Inc., 1990.

Grafik Eye® Multi–Scene Preset Dimming Controls Models 3100 & 4100 Brochure, Lutron Electronics Co., Inc., 1996.

Grafik Eye® Low Cost, High Performance Architectural Lighting Control System for Auditoriums, Hotels, and Restaurants Brochure, Lutron Electronics Co., Inc., 1994.

Grafik 6000™ Lighting Control System Brochure, published by Lutron Electronics Co., Inc., 1995.

Starlite Architectural Wallplate Controls Data Sheets, Electronics Diversified, Inc., 1987.

Compli Environmental Control Systems Compli–SC and Compli–LM Information Material,Lightolier® Controls, 1991.

*Primary Examiner*—Arnold Kinkead

*Attorney, Agent, or Firm*—Woodcock Washburn Kurtz Mackiewicz & Norris, LLP

[57] ABSTRACT

A wall mountable control panel for controlling power levels delivered to electrical loads, such as lighting loads defining zones, has a zone select switch for scrolling through multiple zones, so as to permit a single control unit (having a power level adjustment switch and a power level display for one zone) in the control panel to be used to separately adjust the power level for, and separately display the power level of, more than one zone. The control panel is capable of controlling M times N zones, where N is the number of control units in the control panel, and where M represents the number of selections that can be made by the zone select switch.

14 Claims, 5 Drawing Sheets

WALL MOUNTABLE CONTROL SYSTEM WITH VIRTUALLY UNLIMITED ZONE CAPACITY

FIELD OF THE INVENTION

The present invention relates generally to wall mountable control systems, and more specifically to a programmable wall mountable lighting control system having the capacity to control virtually a limitless number of zones.

BACKGROUND OF THE INVENTION

Commonly assigned U.S. Pat. No. 5,191,265 entitled "Wall Mounted Programmable Modular Control System" (the 265 patent) describes a fully modular, wall mountable control system for use with various loads, and particularly lighting loads. The entirety of the 265 patent is incorporated herein by reference. The control system described in the 265 patent employs a master unit and at least one slave unit to independently control loads, such as lighting zones. In the context of lighting control, a zone is defined as one or more light sources that are commonly controlled, i.e., by the master or by one of the slaves, but a zone can include any type of load that can be electrically controlled. Each master and slave contains control electronics for controlling one zone, although the 265 patent also describes a slave that has a pair of control units for controlling two zones. As used herein, and unless a contrary intent is indicated elsewhere, the term "control unit" means those control electronics and associated actuators (pushbuttons, sliders, switches and the like) present in a wall mountable control panel needed to control a zone, including programming of a zone. Further, as used herein, and unless a contrary intent is indicated elsewhere, the term "control panel" means the wall mounted housing containing all of the control units.

According to the system described in the 265 patent, each control unit has an intensity raise/lower actuator, and associated electronics, for programming/controlling a single zone, and a display for providing an indication of the intensity level of a single zone. In other words, each control unit is capable of programming and controlling only one zone. Thus, increasing the number of zones to be controlled requires increasing the number of control units by the addition of modular slave units.

A commercial embodiment of the control system described in the 265 patent has been offered for sale and sold by the assignee hereof, for more than one year before the filing date of this application, under the trademark GRAFIK Eye®. However, unlike the system described in the 265 patent, the GRAFIK Eye® system is not modular. Rather, the control units of the GRAFIK Eye® are hard-wired together within the control panel. As in the case of the 265 patent, each control unit in the GRAFIK Eye® control panel has an intensity raise/lower actuator, and associated electronics, for programming/controlling a single zone, and a display for providing an indication of the programmed intensity level, or actual intensity level, for a single zone. Each control unit is capable of programming and controlling only one zone. Because the control units are not modular and are hard-wired together, the control panels are manufactured in selected sizes to control only pre-selected numbers of zones. Thus, plural control panels may be needed to control more zones than can be controlled with the largest single control panel sold by the manufacturer. In addition, any increase in the number of zones desired to be controlled after original installation requires purchase of a new control panel with the extra control units.

One commercial version of the GRAFIK Eye® system, known as the GRAFIK Eye® Model 4100, differs from the system primarily described in the 265 patent in that the dimming electronics used to respond to the commands of the GRAFIK Eye® Model 4100 control panel and to directly control the zones are remotely located, and communicate with the GRAFIK Eye® control panel over a low voltage, class 2, four wire link. However, the 265 patent does describe the use of remote dimming circuits at column 15, lines 10 et seq. The remote dimming electronics adjust the delivered power level to the light sources of each zone in response to digital commands received over the four wire link. Dimming electronics for use with the GRAFIK Eye® Model 4100 control panel are commercially available from the assignee hereof and are sold under the mark GRAFIK Eye® GP Dimming Panel. Commonly assigned U.S. Pat. No. 5,530,322 entitled "Multi-Zone Lighting Control System" (the 322 patent), the entirety of which is incorporated herein by reference, also describes the structure and operation of a remote dimming panel that may be employed with a programmable wall mountable control panel in the manner suggested at column 15, lines 10 et seq. of the 265 patent. The GRAFIK Eye® GP Dimming Panel is a commercial embodiment of the system described in the 322 patent, and the 322 patent generally describes the structure and operation thereof. The GRAFIK Eye® GP Dimming Control Panel is capable of receiving commands from up to eight GRAFIK Eye® control panels to control up to 64 zones. Each GRAFIK Eye® control panel has its own unique address which is incorporated into the digital commands.

The GRAFIK Eye® system, including the GRAFIK Eye® Model 4100 control panel and the GRAFIK Eye® GP Dimming Panel are described in a brochure published by Lutron Electronics Co., Inc. as part number P/N 360-449 entitled "GRAFIK Eye® Multi-Scene Preset Dimming Controls" (1996), the entirety of which is also incorporated herein by reference.

Each of the systems described above requires the use of a great amount of hardware, and the use of a great amount of wall space for the control units, to control a large number of zones. Thus, a system with a large number of zones can be unsightly and costly. The present invention overcomes this problem.

SUMMARY OF THE INVENTION

A wall mountable control system according to the present invention comprises a wall mountable control panel and a plurality, N, of control units within the wall mountable control panel, each for controlling an electrical load, such as a lighting load comprising a zone. Each control unit has a single, user operable, switch means disposed on a face of the control panel for setting a power level desired to be delivered to zones assigned to the control unit. Each control unit also has a single display means for displaying the power level for its assigned zones, there being N switch means and N display means. Each single switch means is operable to separately set the power level for more than one zone, and each single display means is operative to separately display the power level for more than one zone.

There is also provided a user operable zone selection means disposed on the face of the control panel, with means for making M selections of the zones to be controlled. The control system is capable of controlling M times N zones, where M is an integer greater than 1. The zone selection means permits selection, at any given time, of N ones of the M times N zones whose desired power levels are to be set by the switch means and displayed by the display means.

A zone display is provided on the face of the control panel for indicating the identity of the zones selected by the zone selection means.

Preferably, the control panel of the present invention is adapted to be received by a ganged plurality of NEMA standard 3" high by 1 31/32" wide wall boxes.

DETAILED DESCRIPTION OF THE PREFERRED EMBODIMENT

Figure 1:
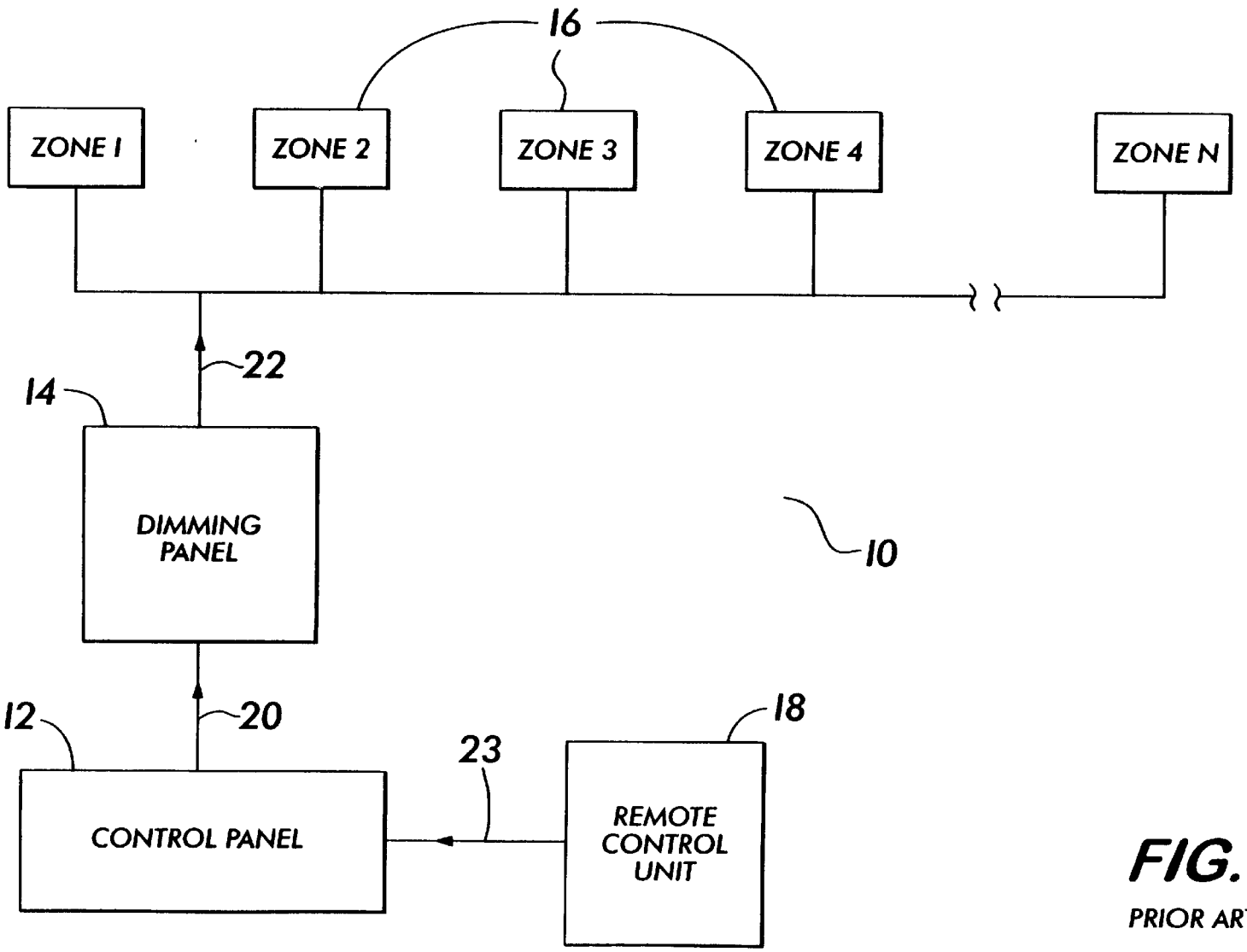
FIG. 1 PRIOR ART
FIG. 1 is a block diagram depicting a prior art lighting control system.

Referring now to the drawings, wherein like numerals indicate like elements, a presently preferred embodiment of the invention will now be described. Although the instant specification and the specifications of the 265 and 322 patents employ many like reference numerals, those like numerals are not necessarily intended to refer to like elements in all three specifications. Similarly, the instant specification and the specifications of the 265 and 322 patents, on occasion, refer to like elements, but like elements are not necessarily referenced by like reference numerals in all three specifications.

Referring to FIG. 1 hereof, there is shown a block diagram of the above described prior art GRAFIK Eye® Model 4100 lighting control system, labeled generally 10. For convenience, the preferred embodiment of the invention is described herein as a modification to the prior art system 10, but the invention is by no means limited thereto, and the invention may be employed in any system capable of independently controlling multiple zones. Also, for convenience, the invention is described herein as being for use in a lighting control system, but the invention is by no means limited thereto, except as expressly set forth in the appended claims. Rather, the invention has application to any type of load that may be electrically controlled.

As shown, the prior art system 10 comprises a control panel 12 that provides digital commands over a low voltage, class 2, four wire link 20 to remote dimming circuitry 14 (hereinafter "dimming panel"). Alternatively, the commands may originate from a remote wall mounted control unit 18 and be provided to the control panel 12 over a low voltage link 23. Dimming panel 14 responds to the commands to adjust the power level delivered to various ones of the loads over a plurality of AC lines 22. Each of the loads defines a zone 16. Zones 16 may comprise various types of lighting loads. As is known in the art, and as explained in the 265 patent, different combinations of on/off and/or intensity conditions of zones 16 define scenes. Various scenes may be programmed by and selected from the control panel 12. The control panel 12 may comprise the GRAFIK Eye® Model 4100 control panel and the dimming panel 14 may comprise the GRAFIK Eye® GP Dimming Panel, both of which are commercially available from Lutron Electronics Co., Inc., Coopersburg, Pa., the assignee of the instant application. The prior art GRAFIK Eye® Model 4100 system 10 is a combination of the systems described in the above referenced 265 and 322 patents, with the 265 patent describing the control panel 12 (except as noted above) and the 322 patent describing the dimming panel 14.

Figure 2:
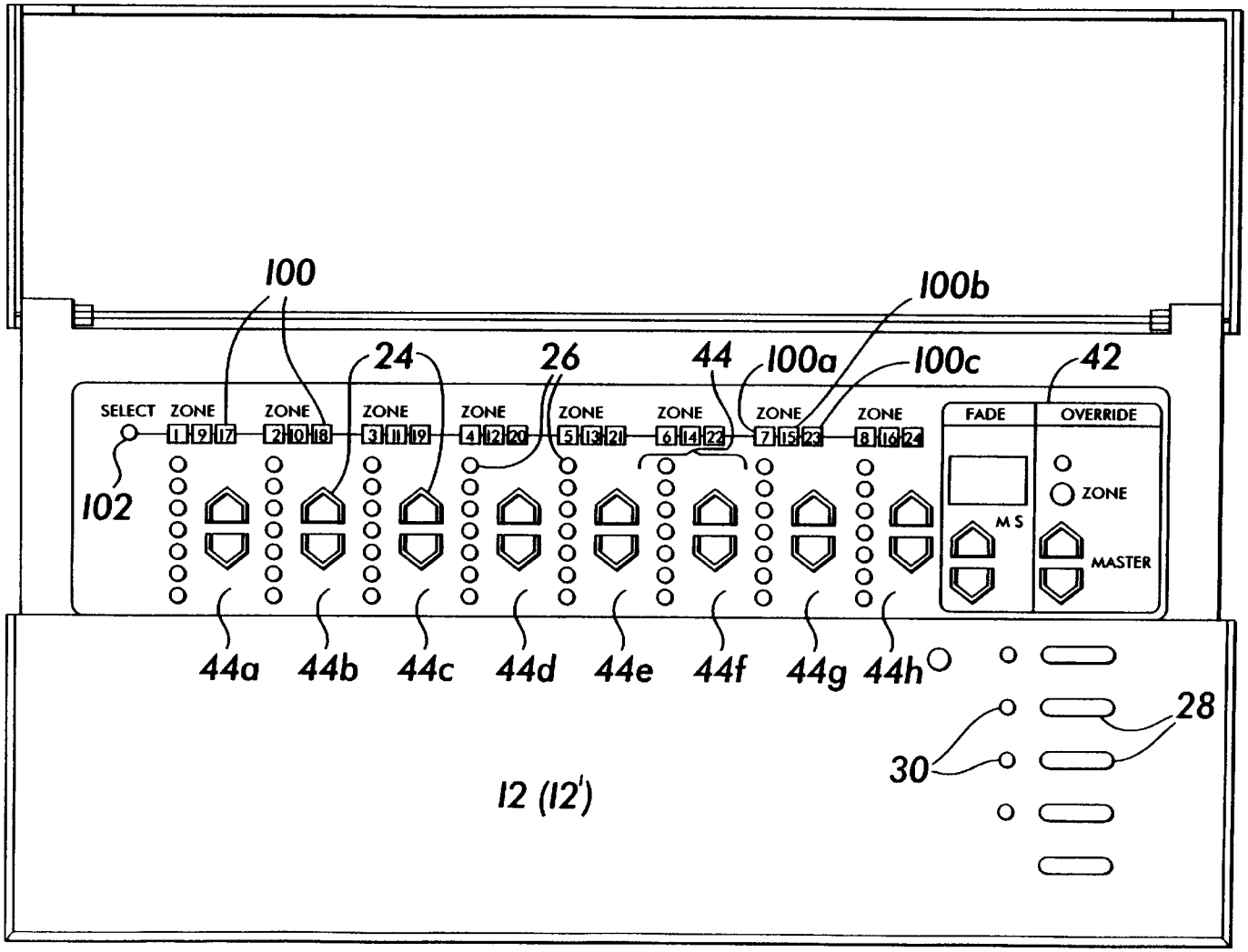
FIG. 2 depicts one embodiment of a front panel of a control panel according to the present invention.
Figure 3:
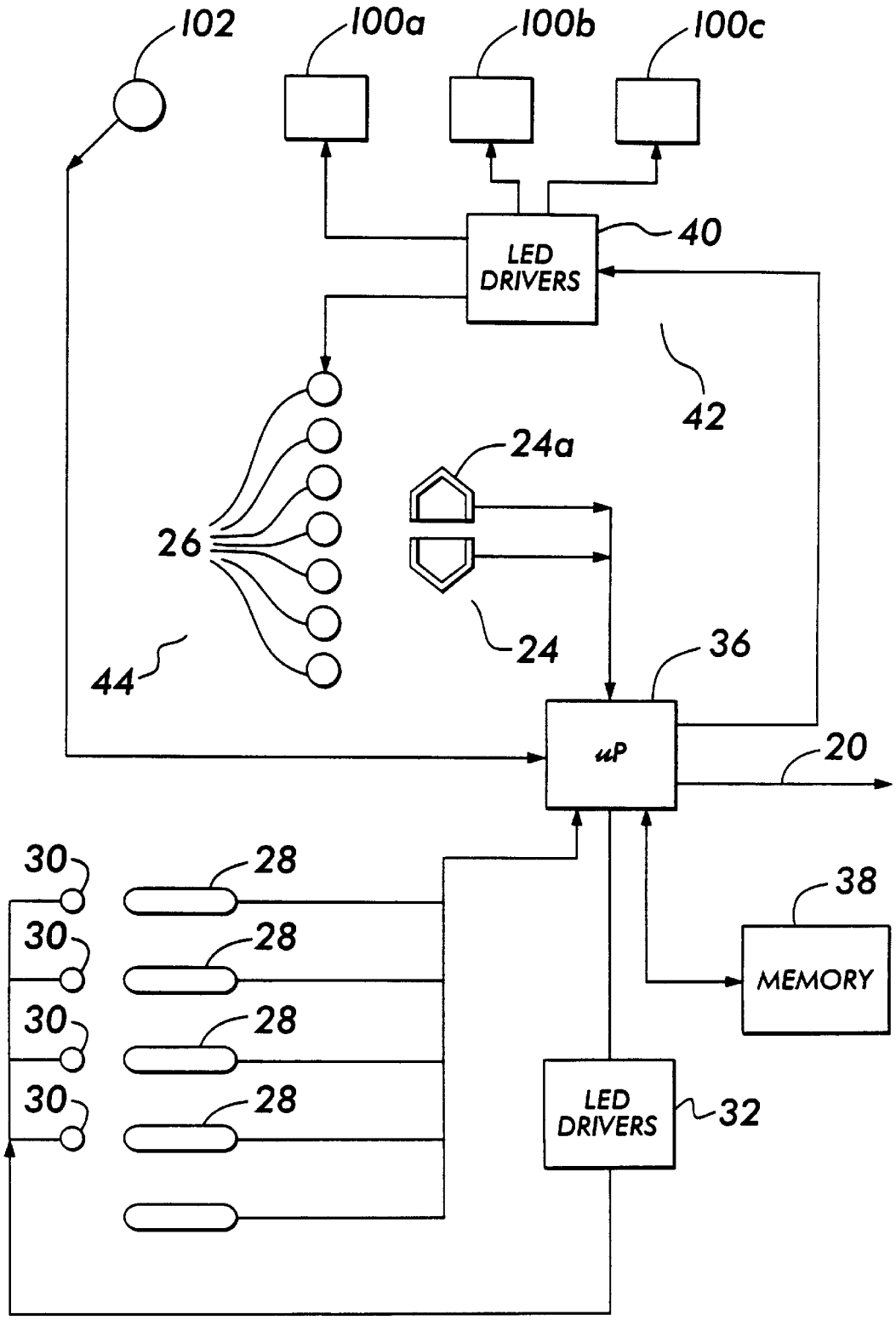
FIG. 3 illustrates one embodiment of electrical details of a control panel according to the present invention.

Except for the items labeled 100 and 102, FIG. 2 illustrates the front panel of the prior art GRAFIK Eye® Model 4100 control panel 12. The functions of the various actuators and displays are fully described in the 265 patent. Briefly, actuators 24 are intensity raise/lower pushbutton switch actuators (or other types of actuators) for setting and adjusting the desired power levels to be delivered to various ones of the zones 16, i.e., for setting and adjusting the desired intensity levels thereof. In the prior art system 10, one zone is associated with each actuator 24. Also associated with each actuator 24 is a display 26 for indicating the power/intensity level to be delivered to the zone 16 associated with the particular actuator 24. As described in the 265 patent, each actuator 24 may comprise a pair of pushbutton switch actuators for operating switches for raising or lowering the intensity levels of a zone 16. Each display 26 may comprise a plurality of LED's that form a "bar graph" display to indicate the set intensity level. Alternatively, other types of displays may be employed. Scene select pushbutton switches 28 are provided for selecting scenes, and LED's 30 are provided for indicating the selected scene. As more fully described in the 265 patent, actuators 24 and scene select pushbutton switches 30 are employed to program scenes, by setting (and later adjusting, if desired) the desired intensities for the zones 16 corresponding to each scene. As shown in FIG. 3, and as also described in the 265 patent, the prior art control panel 12 has a microprocessor 36 that controls the functions of the control panel 12, including control of communications with the dimming panel 14. Microprocessor 36 receives input from the scene select pushbutton switches 28 and the actuators 24, and provides signals to displays 26 and LED's 30 via LED drivers 32 and 40, and to memory 38, to carry out the functions thus far described. Program code and data (programmed intensity levels, scene data, etc.) are stored in memory 38 which communicates with microprocessor 36.

Each actuator 24, together with its associated display 26, defines a control unit 44, and thus each control unit has a single intensity raise/lower actuator 24 and a single display 26 for indicating the set intensity level for its associated zone. The exemplary control panel illustrated in FIG. 2 has eight (8) control units 44. In addition, it has controls and displays 42, and scene select switches 28 and LEDs 30, the function of which is described in detail in the 265 patent. The exemplary prior art control panel 12 is therefore capable of controlling up to, and no more than, eight (8)zones.

The present invention permits each control unit 44 to separately control (i.e., separately set and adjust the desired intensity level for) more than one zone, and to separately display the intensity level of each zone controlled by each control unit 44.

The presently preferred embodiment of the invention is carried out by modification to the above described prior art GRAFIK Eye® control panel 12. No modifications are required to the remainder of the system 10. In particular, as shown in FIGS. 2 and 3, control panel 12 is modified by providing a zone select pushbutton switch means 102 and a plurality of zone displays 100 (one for each control unit 44), and by modifying the program code described in the 265 patent that controls the operation of microprocessor 36, as hereinafter described. FIG. 2 has been labeled 12 (12') to indicate that presently preferred embodiment of the control panel (12') of the present invention incorporates many of the features of the prior art control panel (12). Thus the reference numeral 12 has been and will be used to describe the illustrated prior art control panel, and the reference numeral 12' will be used to describe the illustrated control panel that employs the present invention.

According to the invention, each control unit 44 is shared among several zones, and selection of the particular zone to be set or adjusted by each control unit is performed by operating the zone select pushbutton switch means 102. It should be understood that the invention is not limited to the use of a pushbutton switch means for zone selection, and any type of selector, such as rotary switch, dial switch, or the like may be employed for zone selection. Each control unit 44 has an associated zone display 100 for illustrating the zone that has been selected. Each zone display 100 may comprise a plurality of separately illuminable devices 100*a*, 10*b*, 100*c*, etc. for identifying the zone that has been selected, such as shown in FIG. 3, or another type of display type, such as a digital display, may be employed. In the illustrated embodiment, each control unit 44 is capable of separately controlling up to three zones, and thus each zone display 100 associated with each control unit 44 has three separately illuminable devices, or windows, 100*a*, 100*b*, 100*c*. Thus, in the illustrated embodiment, up to 24 zones may be separately controlled via the control units 44, even though there are only eight control units 44, eight actuators 24 and eight displays 26. Zone numbers may be placed over the illuminable devices, or in the windows, for identifying the identity of the selected zones.

In the preferred practice of the invention, zones are organized into groups, and zone select pushbutton switch means 102 is used to select which group is to be controlled by the control units 44. In the illustrated embodiment of the invention, there are three groups of zones that can be selected. A first group comprises zones 1–8; a second group comprises groups 9–16; and a third group comprises zones 17–24. Zones 1, 9 and 17 are controlled via the control unit 44*a*; zones 2, 10 and 18 are controlled via the control unit 44*b*; zones 3, 11 and 19 are controlled via the control unit 44*c*, zones 4, 12 and 20 are controlled via the control unit 44*d*; zones 5, 13 and 21 are controlled via the control unit 44*e*; zones 6, 14 and 22 are controlled via the control unit 44*f*; zones 7, 15 and 23 are controlled via the control unit 44*g*; and, zones 8, 16 and 24 are controlled via the control unit 44*h*. According to operation of the illustrated embodiment of the invention, when zone select pushbutton switch means 102 is operated, a different group of zones to be controlled is selected. A first operation may select the first group, a second operation may select the second group, etc., until the last group has been reached; thereafter, the next operation may re-select the first group, such that repeated operations result in cyclic selection. Each time the zone selection switch means is operated, the zone displays 100 indicate the identity of the zones that have been selected. A selected zone may sometimes be referred to hereinafter as an "active zone", and a selected zone group may sometimes be referred to hereinafter as an "active zone group." Each actuator 24 controls only its active zone, and each display 26 displays only the intensity level for its active zone. Each time that a new intensity level is set for an active zone via an actuator 24, new intensity (power level) data is stored for that zone in the memory 38, and the stored data is used to display the intensity level for the active zone on the associated display 26. It will therefore be appreciated that portions of memory 38 are allocated to each zone to be controlled, and that operation of the zone select pushbutton switch means 102 serves, under control of microprocessor 36, to select those memory locations for display, and updating if any of the actuators 24 have been operated.

In the preferred embodiment of the present invention, three consecutive control panel addresses are assigned to the control panel 12', one for each group of zones. This allows the aforementioned prior art dimming panel 14 to be used in combination with the present invention without modification to that dimming panel. The operation of the preferred embodiment of the invention differs from that described in the 322 patent only in that the program code automatically assigns multiple consecutive addresses to the control panel. Hence a 24 zone control panel (the equivalent of three eight-zone units in zone quantity) would take the first three addresses available (referenced as U1, U2, and U3 in the 322 patent). During a sequential polling operation of the system, the first group of zones (1–8) would broadcast their intensities during the time slot allocated to U1, the second group of zones would broadcast their intensities during the time slot allocated to U2, and so on. Otherwise the operation of the preferred embodiment of the present invention is the same as the operation described in the 322 patent at column 6 line 66 through column 8 line 31.

Of course, the illustrated embodiment having eight control units 44, each capable of controlling up to three zones, is exemplary only, and is not intended to limit the scope of the invention in any respect. As will be appreciated, any number of control units 44 may be employed, and the number of zones that can be controlled by each control unit 44 is limited only by the amount of memory 38 and any limitations imposed by the dimming panel 14. According to the invention, the control panel 12' is capable of controlling M times N loads, where N is the number of control units present in the control panel(with one intensity raise/lower actuator 24 and one display 26 per control unit 44), and where M is an integer greater than 1 and represents the number of selections available via zone select switch means 102.

The operation of the invention may be further understood by way of example. Referring again to the illustrated embodiment having eight control units 44 and three groups of zones, suppose that operation of the zone select pushbutton switch means 102 has selected the third zone group, i.e., zones 17–24. Zones 17–24 hence become the active zone group. Microprocessor 38 will cause each of the zone displays 100*c* to be illuminated to indicate that zones 17–24 have been selected. Microprocessor 38 will also read the intensity data stored in memory 38 for these zones and will cause the displays 26 to provide an indication of the stored intensity level for these zones. Should any of actuators 24 be operated so as to adjust the desired intensity level, corresponding new intensity (power level) data will be written to the portion of memory 38 corresponding to the zone(s) in the third zone group (the active zone group) that was (were) adjusted, and the corresponding displays 26 will alter their indications accordingly. The next operation of zone select pushbutton switch means 102 will select the first zone group, i.e., zones 1–8. Zones 1–8 hence become the active zone group. Microprocessor 38 will cause each of the zone displays 100*a* to be illuminated to indicate that zones 1–8 have been selected. Microprocessor 38 will also read the intensity data stored in memory 38 for zones 1–8 and will cause the displays 26 to provide an indication of the stored intensity level for zones 1–8. Should any of actuators 24 be operated so as to adjust the desired intensity level, corresponding new intensity (power level) data will be written to the portion of memory 38 corresponding to the zone(s)in the first zone group (the active zone group) that was (were) adjusted, and the corresponding displays 26 will alter their indications accordingly. Thus, each operation of the zone select pushbutton switch means 102 is operative to scroll through different ones of the locations of memory 38 and recall the data stored therein.

The data stored in memory 38 (intensity level data, etc.) is periodically communicated by the microprocessor 38 over the four wire link 20 to dimming panel 14, which is responsive thereto to deliver a level of power to each of the zones in accordance with the transmitted intensity data, as described in the 322 patent. The data is communicated for all zones, not just the zones in the active zone group.

Figure 4:
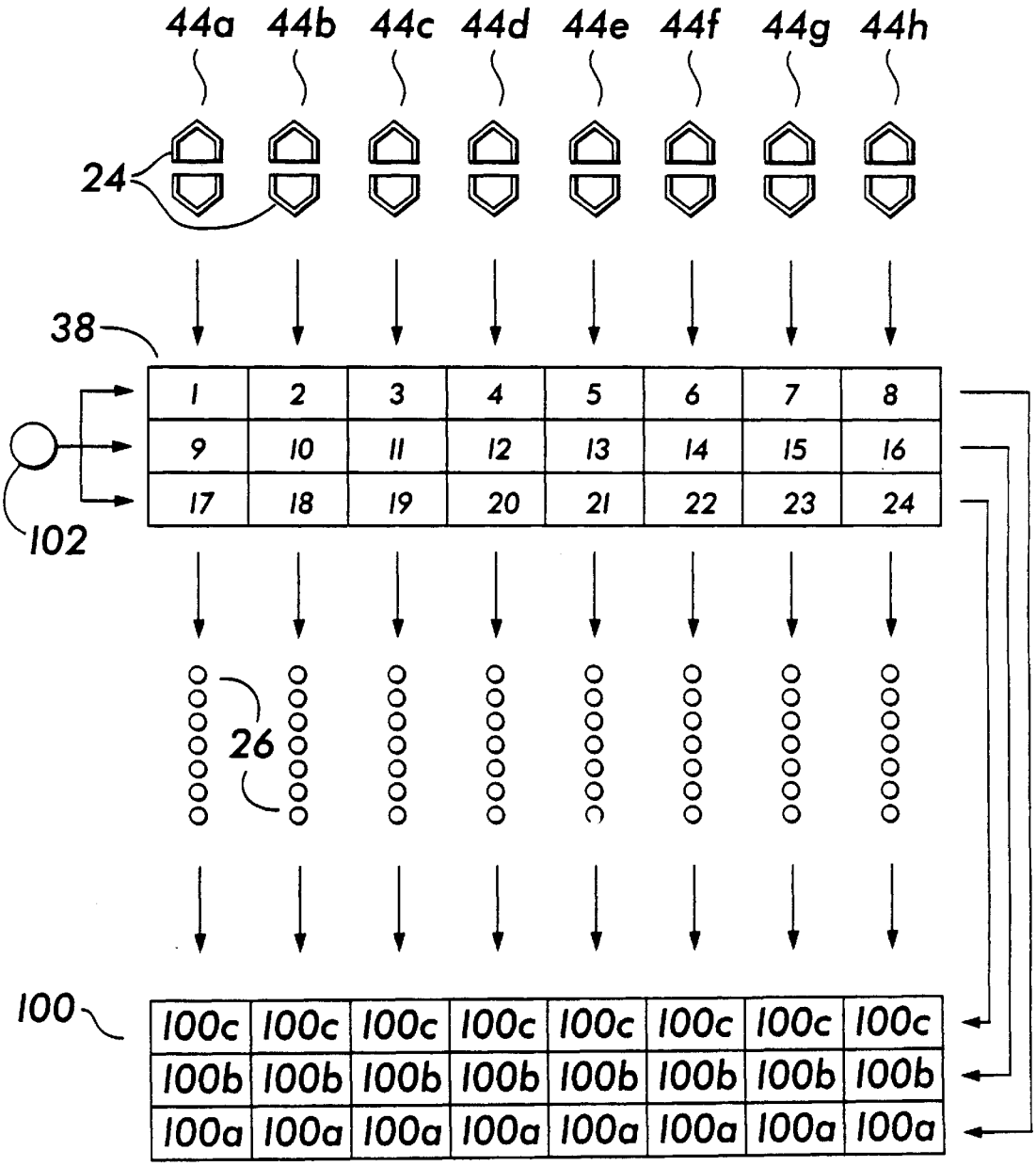
FIG. 4 graphically illustrates the cooperation between a memory employed by the invention, and the actuators, switches and displays employed by the invention.

FIG. 4 is provided for the purpose of facilitating an understanding of the underlying concepts of the invention. With further reference to the illustrative embodiment discussed above, FIG. 4 conceptually illustrates: functional allocation of memory 38 among the three zone groups; the functional manner in which zone groups are selected by the zone select pushbutton switch means 102; the functional manner in which the memory receives data from the actuators 24; the functional manner in which data in the memory is read-out to displays 26; and the functional manner in which the zone displays 100 are illuminated. FIG. 4 thus conceptually illustrates the manner in which the actuators 24 and displays 26 cooperate with the memory 38 to achieve the functions of using a single actuator to separately control several zones and of using a single display to provide indications of the intensity levels for several zones. Conceptually, each horizontal row represents the memory locations corresponding to a zone group. Conceptually, each vertical column represents the memory locations corresponding to a control unit 44. Operation of the zone select pushbutton switch means 102 causes microprocessor 36 to select the portions of memory 38 corresponding to one of the three horizontal rows. Intensity level data is read from the memory locations corresponding to the selected horizontal row and displayed on the displays 26 that correspond to the vertical columns. Operation of any of the actuators 24 will cause new intensity data to be written to the memory location that corresponds to the selected horizontal row and in the same vertical column as the operated actuator 24. Selected ones of the zone displays 100*a*, 100*b*, 100*c* are illuminated according to the horizontal row that has been selected.

Figure 5:
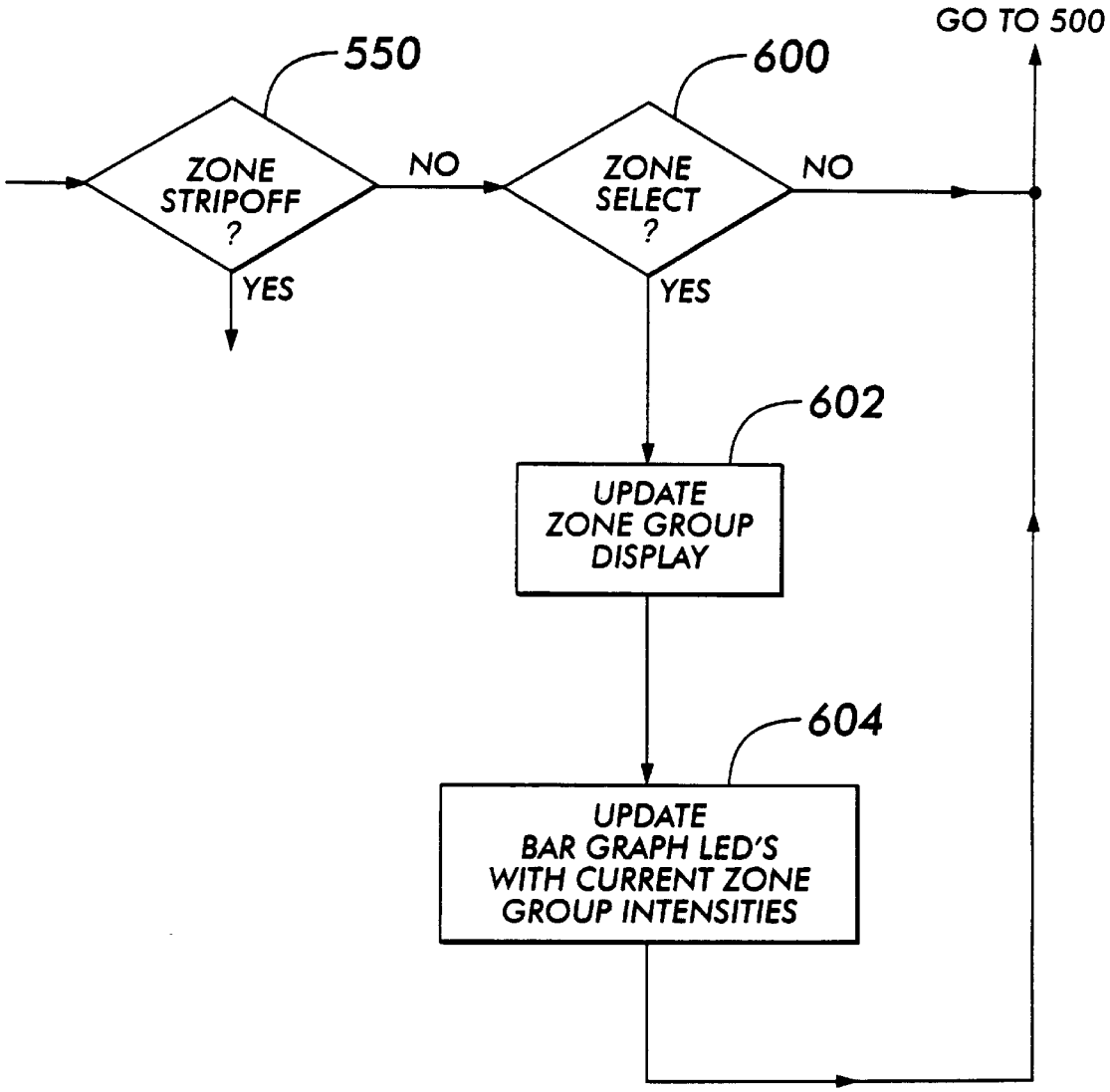
FIG. 5 is a flowchart illustrating a programming modification that may be made to a prior art lighting control system to carry out the present invention.

Except as noted above, FIGS. 18B(1) and 18B(2) of the 265 patent illustrate the operation of the prior art GRAFIK Eye® control panel 12. As mentioned, the present invention employs a modification to this program code to facilitate its implementation in the prior art GRAFIK Eye® control panel. FIG. 5 hereof is a flowchart showing the modification. The modification comprises additional steps needed to be performed by microprocessor 36 to manage memory 38 (as described above), to process input from the zone select pushbutton switch means 102, and to manage illumination of the intensity displays 26 and the zone displays 100. Decision block 550 of FIG. 5 hereof corresponds to decision block 550 of FIG. 18B(2) of the 265 patent. In the practice of the present invention, the additional decision block 600 and additional processing steps 602 and 604 are carried out, and follow decision block 550 of FIG. 18B(2) of the 265 patent. In particular, in the present invention, when it is determined at step 550 that no zone strip off button has been operated, a determination is made at decision block 600 as to whether zone select pushbutton switch means 102 has been operated. If zone select pushbutton switch means 102 has not been operated, then control passes to block 500 of FIG. 18B(1) of the 265 patent. However, if it is determined that zone select pushbutton switch means 102 has been operated, then steps 602 and 604 are carried out. At step 602, a zone group is selected and selected ones of the zone displays 100 are illuminated to identify the selected zones. At step 604, the memory locations corresponding to the selected zones are read and the intensity data stored therein is displayed on the displays 26. Control then passes back to block 500 of FIG. 18B(1) of the 265 patent. If any of the actuators 24 are operated, the new intensity level(s) is (are) stored in the appropriate portion(s) of memory, as indicated at blocks 520 et seq., and particularly block 526, of FIG. 18B(1) of the 265 patent.

It will be appreciated that when the present invention is employed in conjunction with the above referenced GRAFIK Eye® GP Dimming Panel, up to 64 zones may be controlled with only a single control panel 12' having, e.g., eight control units and an eight selection zone select switch means 102, whereas the prior art would require 64 control units, i.e. eight control panels.

The control panel 12' employed in the practice of the present invention is preferably adapted to be received by a plurality of ganged NEMA standard 3" high by 1 31/32 wide wall boxes, as more fully described in the 265 patent. Moreover, it is preferred that all electronics for the control units 44 be mounted behind the front of, and affixed to, the control panel 12', and that the control panel 12, be mountable to the ganged wall boxes, as also described in the 265 patent.

Although the present invention has been described as employing a remote dimming panel 14, the invention is by no means limited thereto. Those skilled in the art will readily appreciate that the present invention may be employed with the dimming electronics packaged within the wall mountable control panel 12'.

The present invention may be embodied in on other specific forms without departing from the spirit or essential attributes thereof, and accordingly, reference should be made to the appended claims, rather than to the foregoing specification, as indicating the scope of the invention.

We claim:

1. A control system comprising:

a) a wall mountable control panel having disposed therein, for mounting in the wall, a plurality of control units each for controlling electrical loads, each control unit having associated therewith, and disposed on a face of the control panel, a single, user operable, switch means for adjusting power levels to be delivered to the loads and a single display means for displaying the power levels, the control system being capable of separately controlling a greater number of loads than there are switch means and of separately displaying a greater number of power levels than there are display means, there being more than one load assigned to each single switch means and each single display means, such that each switch means and each display means share a function of separately adjusting the power level and displaying the power level of each of a plurality of the loads, respectively;

b) a user operable selection means disposed on the face of the control panel for simultaneously selecting a group of zones, whereby loads corresponding to the selected group of zones may have their desired power levels adjusted and displayed by each of the switch means and display means, the switch means adjusting, and the display means displaying, the desired power levels for only the loads corresponding to the selected group of zones;

c) a visual indicator disposed on the face of the control panel for indicating the identity of the loads selected by the user operable selection means.

2. The control system according to claim 1 further comprising a memory for storing data indicative of the desired power levels for each load in separate memory locations, and wherein the user operable selection means comprises a single switch means operative to scroll through different ones of the memory locations and recall the data stored therein upon each operation of the switch means.

3. The control system according to claim 1 wherein there are N control units, and N switch means and N display means, there being one set of switch means and display means associated with each control unit, and wherein the control system is capable of controlling M times N loads, where M is an integer greater than 1, and wherein the user operable selection means has means for making M selections, for selecting N ones of the M times N loads whose desired power levels are to be adjusted by the switch means and displayed by the display means.

4. The control system according to claim 3 wherein a microprocessor within the wall mountable control panel causes data stored in a memory within the control panel for each load to be communicated over a communications link to a remote power control circuit.

5. The control system according to claim 1 wherein the loads are lighting loads, and each load defines a zone, and each of the desired power levels is a selected one of an off condition, a full on condition and an intermediate power level.

6. The control system according to claim 1 wherein the control system is adapted to be received by a ganged plurality of NEMA standard 3" high by 1 31/32" wide wall boxes.

7. A wall mountable control system comprising:

a) a wall mountable control panel;

b) a plurality, N, of control units within the wall mountable control system and affixed to the control panel for controlling electrical loads, each control unit having a single, user operable, switch means disposed on a face of the control panel for adjusting a power level desired to be delivered to an electrical load assigned to the control unit and a single display means for displaying the power level, there being N switch means and N display means, the control system being capable of controlling M times N loads, where M is an integer greater than 1, each single switch means being operable to separately adjust the power level for more than one load, and each single display means being operative to separately display the power level for more than one load;

c) a user operable selection means disposed on the face of the control panel, with means for making M selections, so as to permit simultaneous selection of a group of N zones from M times N zones, whereby loads corresponding to the selected group of zones may have their desired power levels adjusted by the switch means and displayed by the display means, the switch means being operable to adjust the desired power levels for, and the display means displaying the power levels for, only the loads corresponding to the selected group of zones;

d) a load display disposed on the face of the control panel for indicating the identity of the loads selected by the user operable selection means.

8. The control system according to claim 7 further comprising a memory for storing data indicative of the desired power levels for each of the M times N loads in separate memory locations, and wherein the user operable selection means comprises a single switch means operative to scroll through different ones of the memory locations and recall the data stored therein upon each operation of the switch means.

9. The control system according to claim 7 wherein a microprocessor within the wall mountable control panel causes data stored in a memory within the control panel for each load to be communicated over a communications link to a remote power control circuit.

10. The control system according to claim 7 wherein the loads are lighting loads, and each load defines a zone, and each of the desired power levels is a selected one of an off condition, a full on condition and an intermediate power level.

11. The control system according to claim 7 wherein the control system is adapted to be received by a ganged plurality of NEMA standard 3" high by 1 31/32" wide wall boxes.

12. In a wall mountable control system of the type having an affixed, user accessible control panel and a plurality, of ganged control units adapted to be received by a ganged plurality, of NEMA standard 3" high by 1 31/32" wide wall boxes, the control units each having a single user operable switch means disposed on a face of the control panel for adjusting power levels desired to be delivered to electrical loads associated with the control units, each control unit further having a display means disposed on the face of the control panel for providing visual indications of the power levels, the control system having a memory for storing data indicative of the desired power level for each load, and wherein a microprocessor within the wall mountable control panel causes at least selected data stored in the memory to be communicated over a communications link to a remote power control circuit, the improvement comprising:

first means within the control system for enabling the control system to separately control each of M times N loads, where M is an integer greater than 1, with only N switch means and N display means, by switchably allocating, via the memory, M loads to each of the switch means and display means on each control unit, such that each single switch means is operable to separately adjust the power level for M loads, and each single display means is operable to separately display the power level for M loads;

second, user operable, means disposed on the face of the control panel for making M selections so as to permit simultaneous selection of a group of N zones from M times N zones, whereby loads corresponding to the selected group of zones may have their desired power levels adjusted by the switch means and displayed by the display means, the switch means being operable to adjust the desired power levels for, and the display means displaying the power levels for, only the loads corresponding to the select group of zones;

third means disposed on the face of the control panel for providing an identification of the loads selected by the second means.

13. The wall mountable control system according to claim 12 wherein the memory stores data indicative of the desired power level for each of the M times N loads in separate memory locations, and wherein the second means comprises a single pushbutton switch means operative to scroll through different ones of the memory locations and recall the data stored therein upon each operation the push-button switch means.

14. The wall mountable control system according to claim 13 wherein the loads are lighting loads, and each load defines a zone, and each of the desired power levels is a selected one of an off condition, a full on condition and an intermediate power level.

* * * * *